US008769851B2

(12) United States Patent
Picard

(10) Patent No.: US 8,769,851 B2
(45) Date of Patent: Jul. 8, 2014

(54) CHILD SAFETY POST SIGN

(71) Applicant: James Dean Picard, Waunakee, WI (US)

(72) Inventor: James Dean Picard, Waunakee, WI (US)

( * ) Notice: Subject to any disclaimer, the term of this patent is extended or adjusted under 35 U.S.C. 154(b) by 0 days.

(21) Appl. No.: 13/944,553

(22) Filed: Jul. 17, 2013

(65) Prior Publication Data

US 2014/0020271 A1 Jan. 23, 2014

Related U.S. Application Data

(60) Provisional application No. 61/803,560, filed on Mar. 20, 2013, provisional application No. 61/741,281, filed on Jul. 17, 2012.

(51) Int. Cl.
*G09F 15/00* (2006.01)

(52) U.S. Cl.
USPC ..... 40/606.12; 40/607.12

(58) Field of Classification Search
USPC ..... 40/594, 606.12, 607.01, 607.12
See application file for complete search history.

(56) References Cited

U.S. PATENT DOCUMENTS

| | | | | | |
|---|---|---|---|---|---|
| 1,096,580 | A | * | 5/1914 | Webb | 40/606.12 |
| 1,460,351 | A | * | 6/1923 | Remington | 40/612 |
| 3,181,849 | A | * | 5/1965 | Mitchell | 267/140 |
| 3,479,760 | A | * | 11/1969 | Snyder, Jr. | 40/606.12 |
| 3,928,930 | A | * | 12/1975 | Attwood | 40/606.12 |
| 5,016,388 | A | * | 5/1991 | Burress et al. | 47/32.5 |
| 5,359,810 | A | * | 11/1994 | Aul | 47/84 |
| 5,383,296 | A | * | 1/1995 | Vecchione et al. | 40/604 |
| 5,408,782 | A | * | 4/1995 | McConnell | 182/187 |
| 5,560,093 | A | * | 10/1996 | Hutton et al. | 29/432 |
| 5,782,027 | A | * | 7/1998 | Gildea | 40/538 |
| 5,869,159 | A | * | 2/1999 | Padilla | 428/40.1 |
| 6,363,644 | B1 | * | 4/2002 | Frost | 40/607.03 |
| D487,180 | S | * | 2/2004 | Lanzi | D99/43 |
| 8,084,115 | B2 | * | 12/2011 | Lanzi | 428/99 |

* cited by examiner

*Primary Examiner* — Gary Hoge
(74) *Attorney, Agent, or Firm* — Rathe Lindenbaum LLP

(57) ABSTRACT

In one embodiment a child safety sign device is composed of a substrate that may be curved and secured to a post or other structure. Fasteners are provided to affix the sign around mail box posts, sign posts, to provide a message to operators of motor vehicles and or pedestrians.

10 Claims, 8 Drawing Sheets

CHILD SAFETY POST SIGN

CROSS-REFERENCE TO RELATED PATENT APPLICATIONS

This application is a continuation of U.S. Provisional Application No. 61/803,560, filed Mar. 20, 2013 and U.S. Provisional Application No. 61/741,281, filed Jul. 15, 2013 both of which are incorporated herein by reference in their entireties.

BACKGROUND OF THE INVENTION

The present invention is in the general field of signage. More particularly, the technical field of a sign device to be secured to a structure. More particularly, the present invention is in the technical field of a child safety sign device to provide warnings in motor vehicle traffic situations.

SUMMARY OF THE INVENTION

In one embodiment, a child safety sign device is composed of a substrate that may be curved and secured to a post or other structure. Fasteners are provided to affix the sign around mail box posts, sign posts, to provide a message to operators of motor vehicles and or pedestrians.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION OF THE PREFERRED EMBODIMENTS

Figure 1:
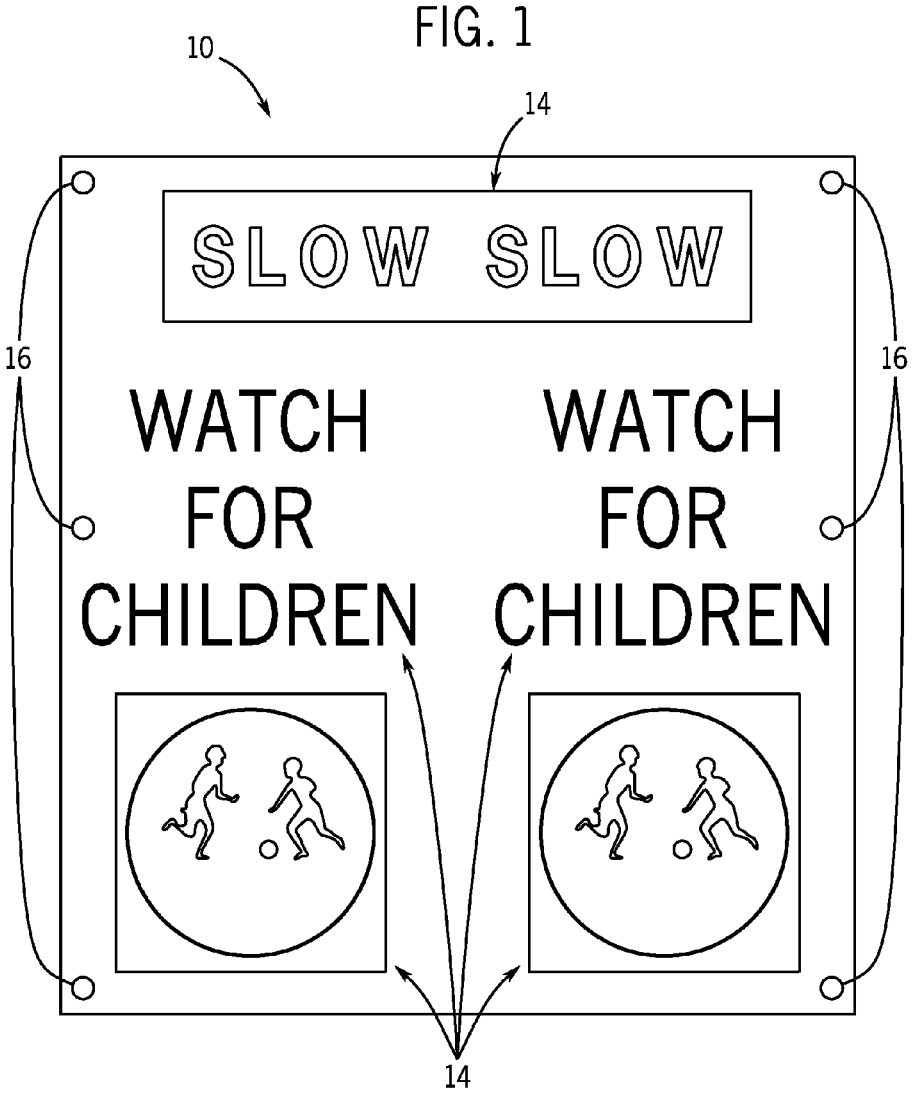
FIG. 1 is a front view of a first sign device.
Figure 2:
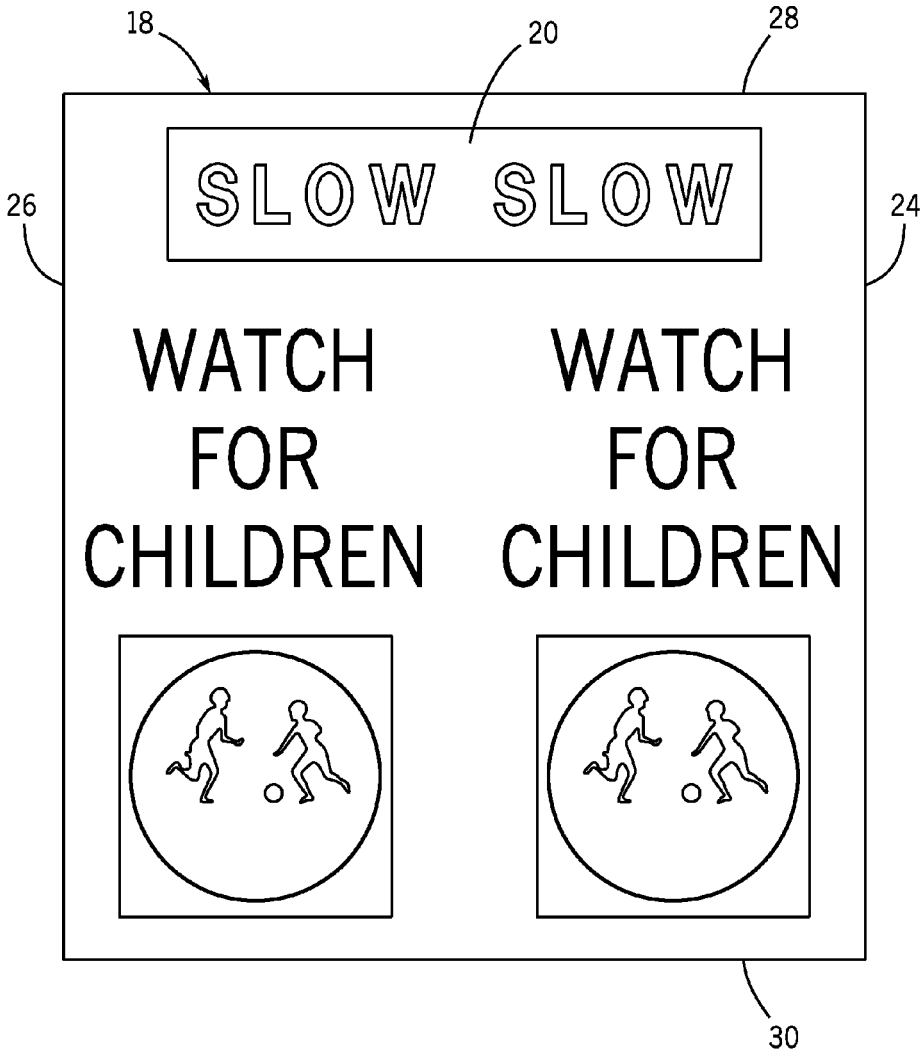
FIG. 2 is front view of a sign device of a second embodiment in a first flat configuration.

Referring now to FIGS. 1 and 2 a sign 10 designed to be affixed around a mail box post or sign post. As discussed below, sign 10 may also be affixed to other structures such as a building, lamp post, fence, fence post, driveway marker or any other structure having at least one surface. In one embodiment sign 10 has thickness of three millimeters ("3 mm"), a horizontal width of twenty-two inches (22"), and a vertical length of thirty-six inches (36"). However other thickness, height and lengths are contemplated, fore example a width of twenty three inches (23") or twenty four inches (24"). In one embodiment sign 10 is formed from a board composed of polyvinyl chloride ("PVC"), or polyethylene, or other suitable material. Other types of materials may also be used. A design may be imprinted on its face 14 through a silk screen or any other printing method known in the art such as digital printing.

Referring to FIG. 1, in one embodiment along each vertical length of the sign 10 are three equidistant one-quarter inch (¼") holes with metal eyelets 16 designed to attach the sign around vertical mail box posts, sign posts and similar near roads and driveways and playgrounds to enable the user to notify operators of motor vehicles that children are present and to slow down. A tie such as an electrical tie or other fastening device may be used to secure one eyelet on one side lateral edge of the sign to a corresponding eyelet on the opposite lateral edge of the sign.

The construction details as shown in FIG. 1 is that the sign 10 may be made of polyvinyl chloride with silk screened graphics imprinted on its face 14 and three equidistant one-quarter inch (¼") holes with metal eyelets 16 or of any other sufficiently similar materials and design to attach the sign around vertical mail box posts, sign posts and similar near roads and driveways and playgrounds to enable the user to notify operators of motor vehicles that children are present and to slow down. Further, the sign 10 and its components may be made of different materials.

Figure 3:
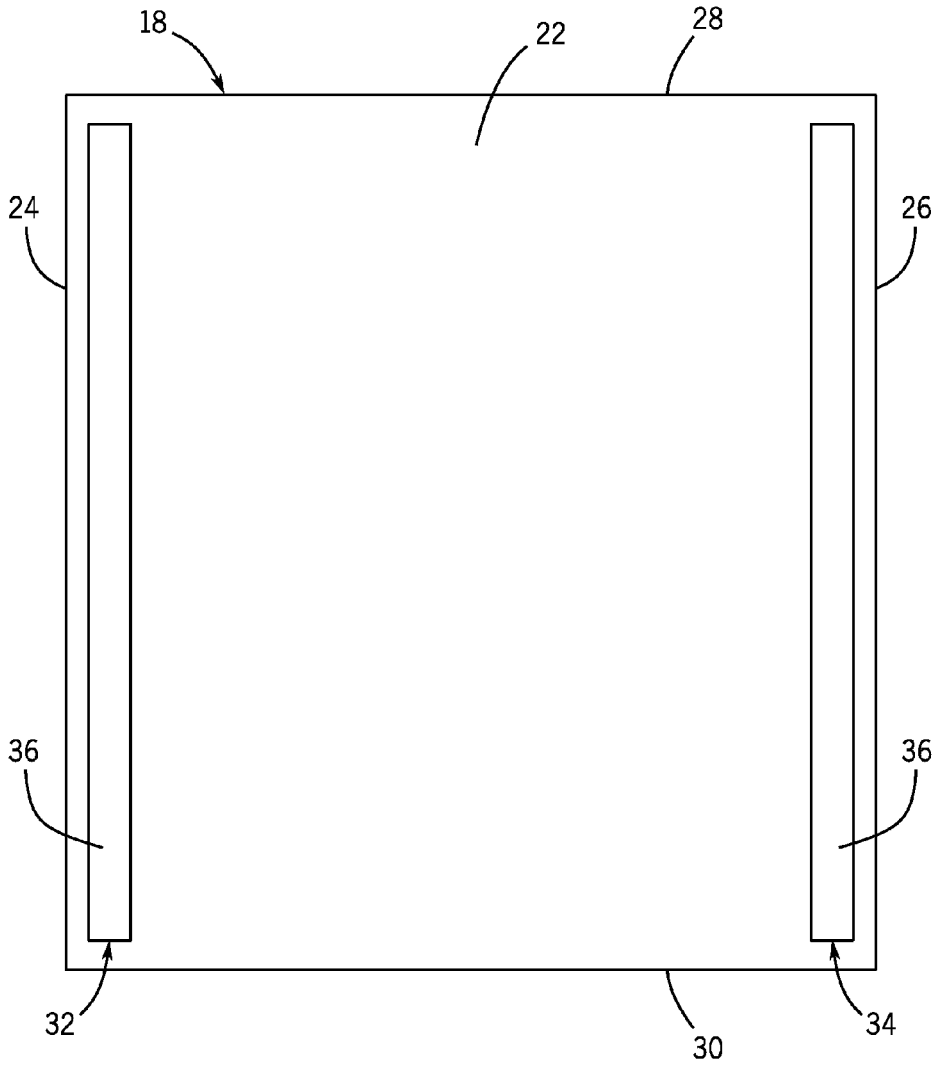
FIG. 3 is a rear view of the sign device of FIG. 2.
Figure 4:
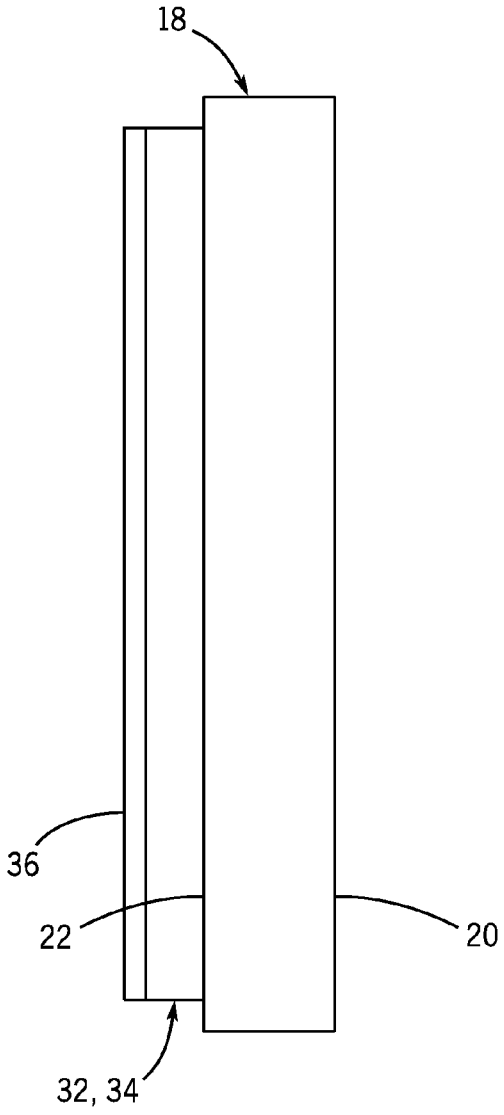
FIG. 4 is a side view of the sign device of FIG. 2.

Referring to FIGS. 2-4 a second embodiment includes a substrate 18 formed from polyethylene material having a thickness of 0.023 inches. Of course, other thicknesses are contemplated. In one embodiment the thickness of substrate 18 is at least 0.01 inches and preferably between 0.015 and 0.03 inches. Substrate 18 includes a front face 20 and an opposing rear face 22, a first pair of lateral edges 24, 26 and a second pair of lateral edges 28, 30 that are generally perpendicular to the first pair of lateral edges 24, 26. A printed image and/or text is provided on the front face 20 of substrate 18. In one embodiment, the image is a safety sign warning of children present that may include the words slow and/or watch for children. However other types of signs and/or messages are contemplated. For example, the sign could be a political sign for a specific candidate or political issue, a notice for a birthday party, anniversary, sport team logos, for sale, for rent, no trespassing, beware of dog, electric dog fence present, etc. In one embodiment, the sign is printed such that it can be viewed when the substrate is formed into a cylindrical or tubular shape.

In one embodiment, a fastener 32 may be provided adjacent to first lateral edge 24. In one embodiment, fastener 32 is double-sided adhesive tape that is secured to the rear face 22 and may include a tape liner 36 removeably secured to the double-sided tape surface distal from rear face 22 of substrate 18. In an alternative embodiment, a second fastener 34 is located proximate to lateral edge 26. In one embodiment, fasteners 32, 34 extend substantially the entire length of lateral edges 22, 24. However, fasteners 32, 34 may be located intermittently along the length of lateral edges 22, 24.

Figure 5:
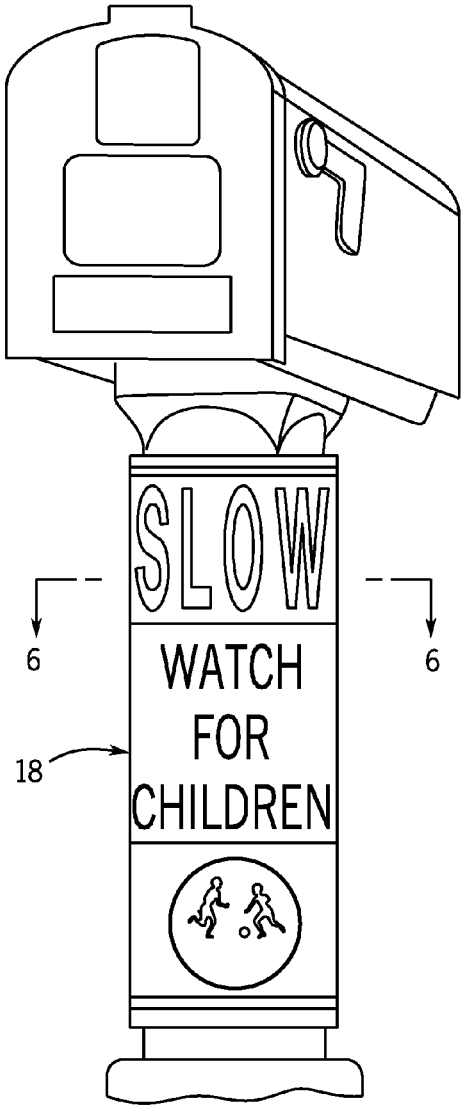
FIG. 5 is a perspective view of the sign device of FIG. 2 located about a structure.
Figure 6:
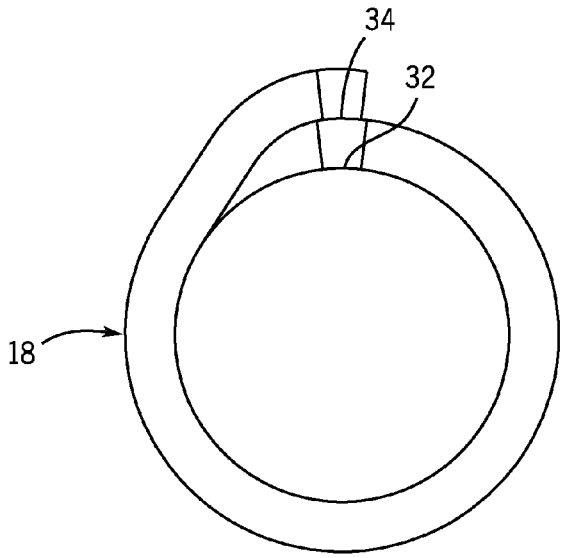
FIG. 6 is a cross-sectional view of the sign device of FIG. 5 taken generally along line 6-6 in a first in use position.

Referring to FIGS. 5 and 6, substrate 18 is located about a post such as a mail box post. In this configuration, fastener 32 may be secured to the post itself along a longitudinal axis of the post. Second fastener 34 is then secured to the front face of substrate 18 proximate lateral edge 24. In an alternative embodiment, fasteners 32 and/or 34 may be a magnetic strip that is adhesively secured to the substrate. The magnetic strip would then allow substrate 18 to be removable from a metal post and reused at a later date. As shown in FIG. 5, substrate 18 is flexible such that substrate 18 may be changed from a flat orientation to a cylindrical shape or other arcuate shape. Substrate 18 in one embodiment is sufficiently flexible to allow the substrate to form a cylinder without creating a crease. Additionally in one embodiment, substrate 18 has sufficient rigidity that when the substrate 18 is formed into a cylinder, it will retain its shape. In one embodiment, the substrate will substantially maintain its shape in winds up to 25 miles per hour.

Figure 7:
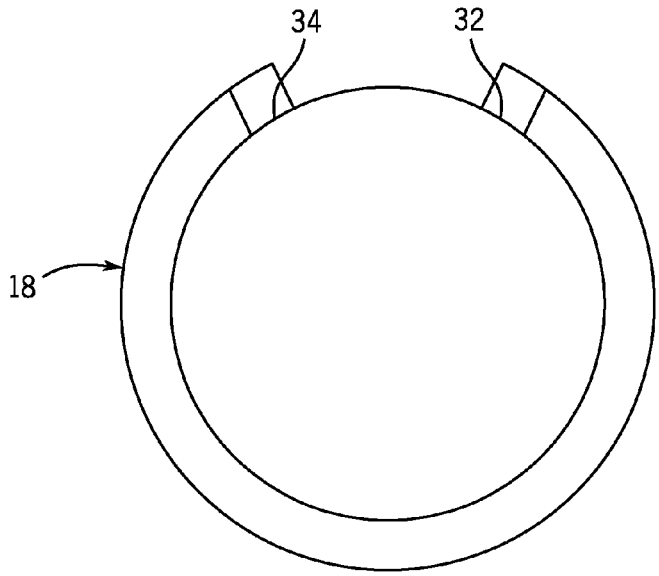
FIG. 7 is a cross-sectional view of the sign device of FIG. 5 taken generally along line 6-6 in a second in use position.

Referring to FIG. 7 a cross-sectional view of substrate 18 is wrapped about a post in which first fastener 32 is secured to a first portion of the post and second fastener 34 is secured to a second portion of the post distal from the first portion of the post. In this embodiment, a portion of the post between the first and second portions may be exposed. Substrate 18 in this embodiment may have a region that is located away from the surface of the post. In alternative embodiments, substrate 18 may be secured flush against the post depending on the size of the post and/or the size of the substrate.

Figure 8:
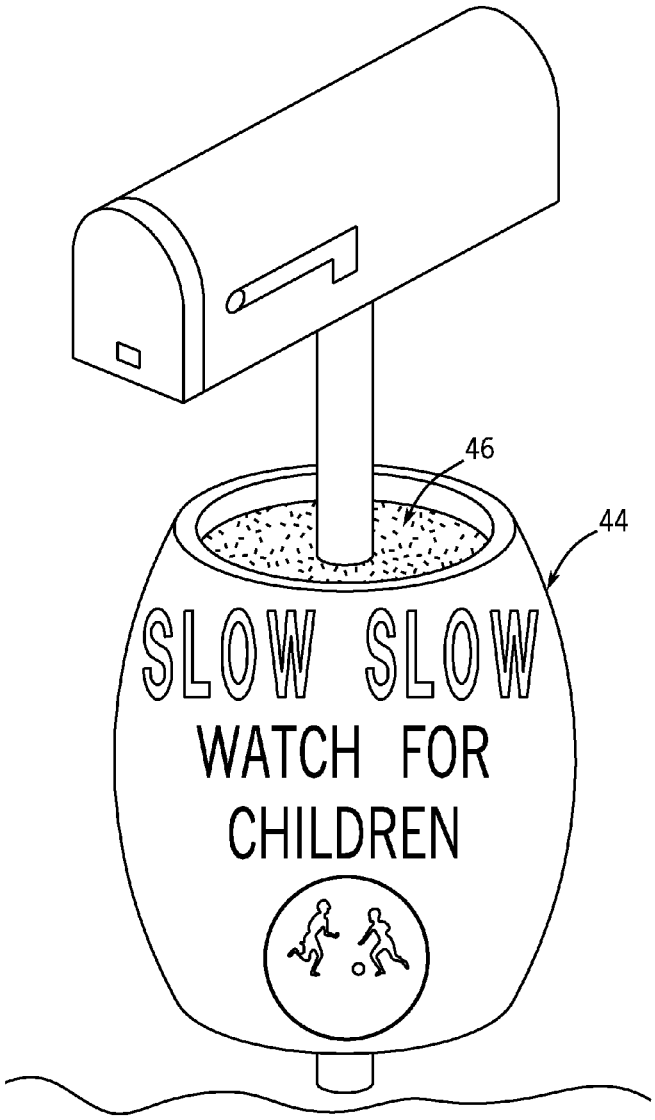
FIG. 8 is an alternative embodiment of a flexible substrate sign.

Referring to FIG. 8 a flexible substrate 44 may be used that may be secured to a post such as a mail box post creating a region 46 between the post and substrate in which leaves may be inserted during the fall season to provide a unique bulging shape. In one embodiment, the flexible substrate may be formed of a plastic that will not retain a generally cylindrical shape without leaves or other debris or material being located between the post and substrate. In another embodiment, substrate may include a sealed chamber that may be inflated to allow the substrate to retain a cylindrical or other inflated shape about a post.

Figure 9:
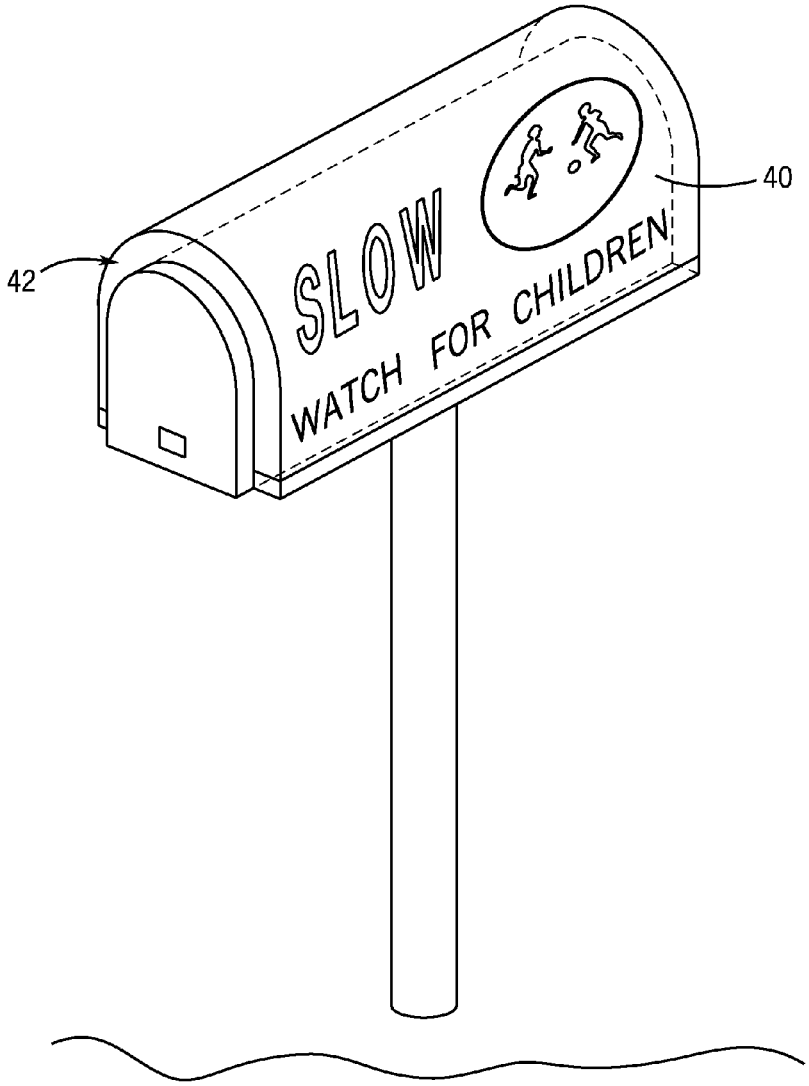
FIG. 9 is an alternative embodiment of a flexible sign secured to a mail box.

Referring to FIG. 9, a substrate 40 may be secured to a mail box to provide a permanent or temporary sign and/or decoration as noted above on to the outer shell of the mailbox. Fasteners may be provided along the longitudinal edges of substrate 40 to operatively secure the substrate 40 to the mail box. A region 42 may be formed between the mail box and the substrate 40, or substrate 40 may be positioned immediately adjacent the entire outer surface of the mail box.

In another embodiment (not shown), substrates 18 and/or 40 may include LED lights 41 that may include a power source secured to the substrate such as a chemical battery and/or a rechargeable battery that may be charged with a solar device such as a photovoltaic panel. The LED lights may be located along the periphery of the substrate and/or may be located in between the lateral edges to highlight certain text and or to be part of the image. In a further embodiment, the LED lights of one substrate may communicate with the LED lights of a second substrate located a distance away from the first substrate. In this embodiment, when a vehicle passes one substrate, LED lights on both the first and second substrates are illuminated for a set period of time.

The construction details of one embodiment is such that sign may be made of polyvinyl chloride with silk screened graphics imprinted on its face and include three or more equidistant one-quarter inch (¼") holes with metal eyelets or of any other sufficiently similar materials and design to attach the sign around vertical mail box posts, sign posts and similar near roads and driveways and playgrounds to enable the user to notify operators of motor vehicles that children are present and to slow down. Further, the sign and its components may be made of different materials.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

What is claimed is:

1. A method of securing a sign to a mail box having a post comprising:

providing a substrate formed from a material having a front surface and a rear surface;

providing a first connector having a first surface and an opposing second surface, the first surface of the connector being secured to the rear surface of the substrate proximate a first lateral edge of the substrate;

positioning the substrate about at least a portion of the mail box post in an arcuate shape such that the rear surface faces toward the post and the front surface faces a direction away from the post;

securing the second surface of the connector to the post;

providing a second connector having a first surface and an opposing second surface, securing the first surface of the second connector to the rear surface of the substrate and connecting a second surface of the second connector to front surface of the substrate;

wherein a portion of the rear surface of the substrate is not in contact with the post forming a gap therebetween.

2. The method of claim 1, wherein the substrate is planar prior to being formed into an arcuate shape.

3. The method of claim 2, wherein the substrate is flexible having a non uniform cross-section when the substrate is secured to the post.

4. The method of claim 2 wherein the post is a mail box post extending vertically from the ground in an upward direction opposite the direction of gravity.

5. The method of claim 2, wherein the substrate is secured to the post such that the substrate is spaced above the ground to which the post extends.

6. The method of claim 1, further providing a second substrate secured to a second post, wherein each substrate includes an LED light in radio contact with one another, where the LED lights are synchronized with one another.

7. The method of claim 6, wherein the LED lights blink on and off simultaneously.

8. The method of claim 6, wherein the LED lights blink on and off in a synchronized and non simultaneous manner.

9. A method of securing a sign to a mail box having a post comprising:

providing a water proof substrate formed from a material having a front surface and a rear surface;

providing a connector proximate a first longitudinal edge of the substrate and providing a second connector proximate a second longitudinal edge of the substrate;

shaping the substrate into an arcuate shape;

securing the first connector to a first portion of the post and securing the second connector to a second spaced portion of the post;

wherein the substrate is formed from a polyvinylchloride material;

wherein the first portion of the post is spaced from and parallel to the second portion of the post;

wherein forming the substrate into an arcuate shape includes forming the substrate into a uniform shape extending from an uppermost portion of the substrate to the lowermost portion of the substrate;

wherein the substrate is formed from flexible material and wherein forming the substrate into an arcuate shape includes forming the substrate into a shape having a non-uniform cross-section;

wherein the substrate includes a region that extends outwardly from the post such that a center portion of the rear surface is spaced from the post;

wherein the region between the substrate and post is filled with leaves.

10. The method of claim 9, wherein the substrate is formed from flexible material and wherein forming the substrate into an arcuate shape includes forming the substrate into a shape having a non-uniform cross-section.

* * * * *